United States Patent [19]

Strader et al.

[11] 4,348,840

[45] Sep. 14, 1982

[54] MODULAR HAZARDOUS DUST COLLECTION PAN AND WALKWAY

[75] Inventors: Charles J. Strader, Perrysburgh; Richard V. Walle, Toledo, both of Ohio

[73] Assignee: Eltra Corporation, Toledo, Ohio

[21] Appl. No.: 152,454

[22] Filed: May 22, 1980

[51] Int. Cl.[3] ..... E04F 19/10

[52] U.S. Cl. ..... 52/180; 15/236 R; 15/241; 52/816; 404/19; 404/36

[58] Field of Search ..... 52/180, 816; 404/19, 404/36, 35, 40; 15/236 R, 237-241

[56] References Cited

U.S. PATENT DOCUMENTS

| | | | |
|---|---|---|---|
| 2,322,965 | 6/1943 | McNeil . | |
| 2,329,678 | 9/1943 | Pennington | 52/180 X |
| 2,843,870 | 7/1958 | Perry | 15/237 |
| 3,050,329 | 8/1962 | Pagan | 15/238 X |
| 3,196,763 | 7/1965 | Rushton . | |
| 3,555,762 | 1/1971 | Constanzo, Jr. . | |
| 3,640,035 | 2/1972 | Butterfield . | |
| 3,921,350 | 11/1975 | VanSchoyck | 52/180 |
| 4,169,339 | 10/1979 | See | 52/177 |

FOREIGN PATENT DOCUMENTS

| | | | |
|---|---|---|---|
| 583317 | 9/1959 | Canada | 15/237 |
| 359156 | 9/1922 | Fed. Rep. of Germany | 15/238 |
| 7701096 | 8/1978 | Netherlands | 15/177 |
| 34322 | 2/1913 | Sweden | 15/177 |
| 3201 | of 1908 | United Kingdom | 15/241 |
| 705119 | 3/1954 | United Kingdom | 52/177 |
| 1183846 | 3/1978 | United Kingdom | 15/238 |

OTHER PUBLICATIONS

Bustin Steel Products, Inc., Dover, New Jersey, Safety Handbook, No. 60, pp. 9, 12.

*Primary Examiner*—Alfred C. Perham
*Attorney, Agent, or Firm*—James P. DeClercq

[57] ABSTRACT

A structure for trapping hazardous dust in a work place which also serves as a walkway is disclosed. A removable cover member (12) includes a frame and a central support member (18), the frame and central support member (18) being covered with expanded metal mesh (22). The cover rests upon a shallow pan (10), the pan (10) having a raised central ridge (28) which is aligned with the central support member (18) in the cover (12) when the cover (12) is placed on the pan (10). The central support member (18) and the central raised ridge (28) cooperate to limit the deflection of the expanded metal mesh (22) under the weight of a user. The lower pan (10) is provided with a hook (34), for engaging other similar pans (10) for assembling a walkway or other desired configuration of dust collecting pans. The pan may be filled with a non-evaporating liquid to permanentaly retain dust falling into the pan, and also dust being scraped from the shoes of a user by the expanded metal mesh.

6 Claims, 4 Drawing Figures

MODULAR HAZARDOUS DUST COLLECTION PAN AND WALKWAY

FIELD OF THE INVENTION

This application relates to the field of capturing hazardous dust from manufacturing operations. In particular, this application relates a modular structure for a combined walkway and hazardous dust collection pan.

BACKGROUND OF THE INVENTION

In many manufacturing industries, dust around the work area is a consistant problem. It is a particularily serious problem in industries working with biologically hazardous materials, such as in the manufacture of lead-acid batteries. As the lead is handled, and as battery assemblies and sub-assemblies move down the production line, metallic lead dust and lead oxide dusts fall to the floor around the machines. Lead on the floor collects on a workers shoes, socks, and clothing, and is stirred up by movement, and inhaled.

To reduce the hazard involved, elevated, open-surface, raised walkways have been provided, so that the worker does not walk directly in the falling dust. A more effective way of minimizing the hazard is to dig pits or trenches around the machines used in the manufacturing operation, and cover these pits or trenches with a perforated cover, and fill them with a fluid, perferably non-evaporative, for entrapping dust particals that may fall through the cover. Such pits or trenches require cleaning from time to time, a difficult and time consuming operation. In addition, it is necessary on an infrequent basis to re-configure a production line to produce various types or styles of battery. In that case, new pits or trenches must be constructed in the flooring around the machines in the revised configuration.

The instant invention overcomes these and other deficiencies of prior attempts to solve a similar problem.

SUMMARY OF THE INVENTION

It is an object of the invention to provide a modular combined collection pan and walkway which may be used to virtually eliminate hazardous dust such as lead in the walking area of a person. It is an advantage of the invention that the collection pan may be used to capture and retain hazardous dust, by being partially filled with oil or with another non-evaporating fluid.

It is a further object of the invention to provide such a device which is easy to clean. It is an advantage of the invention that the possibility of lead dust intoxication by a worker cleaning the device is eliminated. This feature is attained by providing the device with a removable cover, which can be lifted out, and the collection pan vacuumed, in place. Alternately, the device may be emptied and cleaned after removal from an assembly of such devices.

It is a further object of the invention to provide a walkway structure which entraps lead dust, and may be easily repositioned. It is an advantage of such structure that expensive excavation in dust-contaminated pits and trenches is not required to rearrange a production line, it being a feature of the invention that the combined walkway and dust-entrapping pan structure is provided with integral hooks for forming a integrated structure which may be easily re-arranged.

DESCRIPTION OF THE PREFERRED EMBODIMENT

Figure 1:
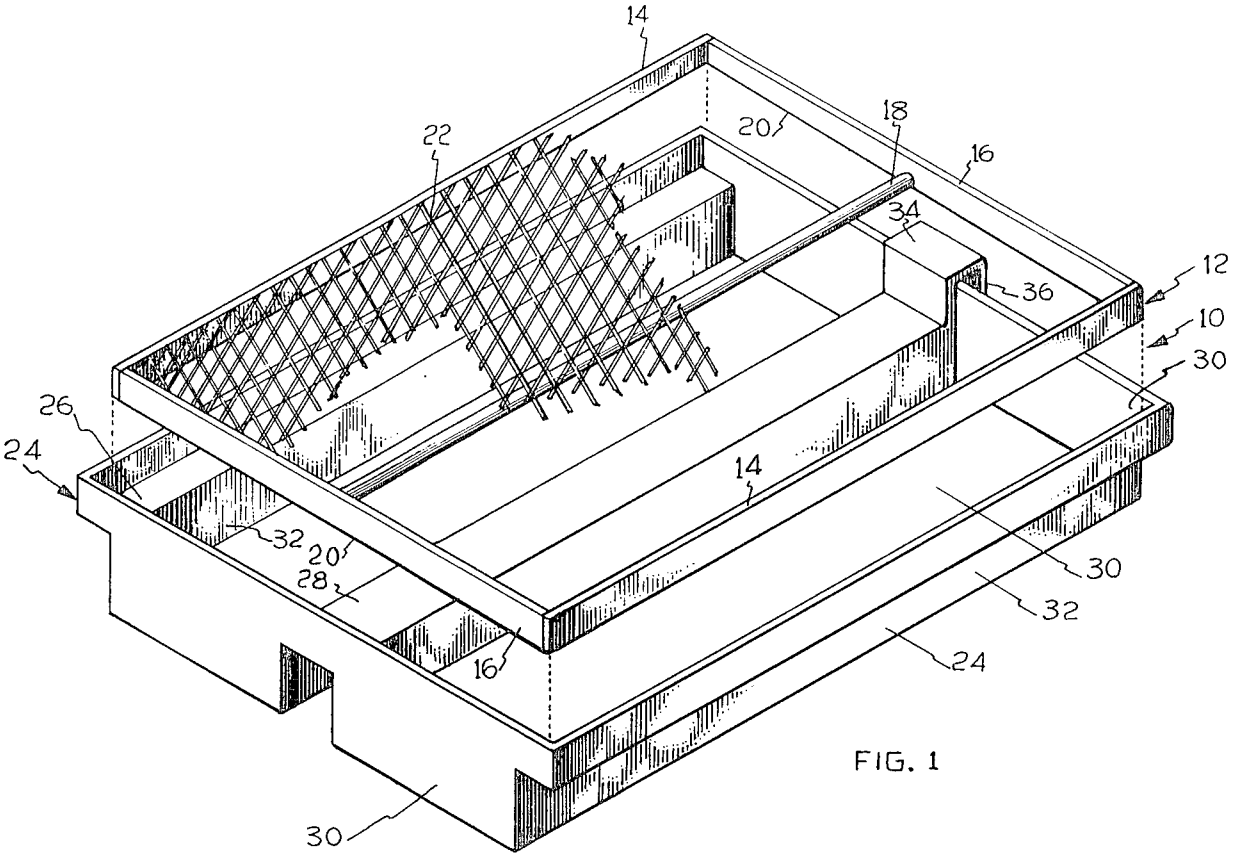
FIG. 1 is a perspective, exploited view showing the preferred embodiment of the invention.

As shown in FIG. 1, the preferred embodiment of the invention includes a pan-shaped structure 10, and a removable cover assembly 12. Cover assembly 12 has two side members 14 and two end members 16, forming a generally rectangular frame, and preferably joined by welding. A support member shown as rod 18 is mounted between end members 16, approximately centered along the links of end members 16, and preferably contiguous with a lower edge 20 of end member 16. Rod 18 and end members 16 are preferably joined by welding. A perforated support surface shown as expanded mesh 22 is preferably welded in place in the frame formed by side members 14 and end members 16, and preferably rests on rod 18, and is joined to rod 18 by welding.

Lower member 10 is generally pan-shaped, and includes lip portion 24 including support surfaces 26 for supporting side members 14 of top member 12. Lower member 10 includes a raised central ridge 28 centrally formed between end walls 30 of lower member 10. In the preferred embodiment, ridge 28 has a generally-rectangular cross section, and is formed as part of bottom plate 31 of lower member 10, side walls 32 being integrally formed with bottom plate 31, and end walls 30 being joined to plate 31 and walls 32 be welding. A means for attaching a lower member 10 to another identical lower member 10 is shown as hook 34, preferably attached to ridge 28 and to one end wall 30 by welding, and having a depending member 36 spaced outwardly from, and parallel, to end wall 30.

Figure 2:
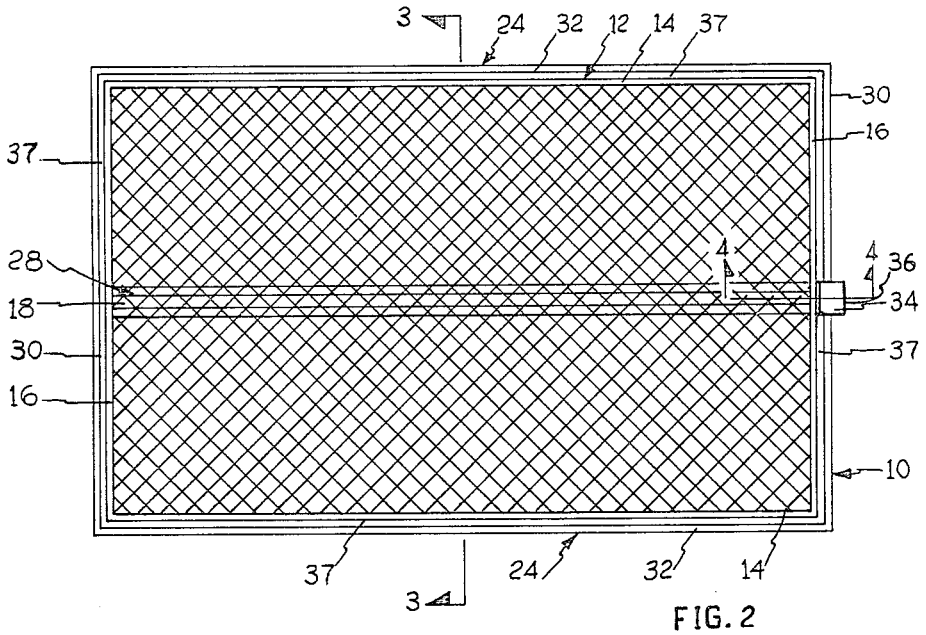
FIG. 2 is a top elevational view of the preferred embodiment of the invention.

As shown in FIG. 2, rod 18 and ridge 28 are aligned when upper member 12 is aligned with lower member 10, and side members 14 are supported on surfaces 26 of lip portion 24. As shown in FIG. 2, there is a gap 37 between end walls 30 of lower member 10 and end member 16 of upper member 12, and between lip portion 24 of side wall 32 and side member 14 of upper member 12. In the preferred embodiment, gap 37 is of a dimension appropriate to accommodate the material of hook member 34, both to allow upper member 12 to be put in place in lower member 10 after hook member 34 is installed, and to allow hook member 34 of other lower members 10 to be attached to the lower member 10 shown in FIG. 2, adjacent either end wall 32 or adjacent end wall 30 opposite hook member 34.

Figure 3:
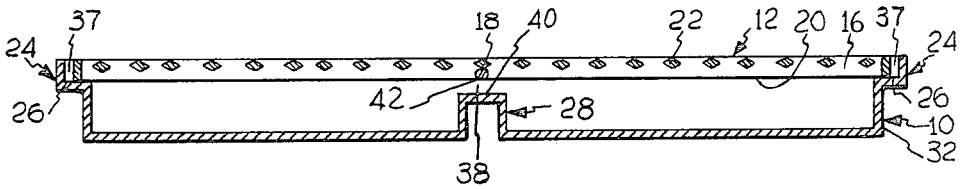
FIG. 3 is a transverse sectional view of the preferred embodiment of the invention, taking in direction 3—3 shown in FIG. 2.

As shown in FIG. 3, the perforated member shown as expanded mesh 22 has a preferably sharp-edged, diamond-shaped cross section, adapted to scrape materials from the bottom of a worker's shoes when walking upon member 22. Also shown in FIG. 3 is a space 38 formed between a lowermost portion of rod 18 and a surface 40 of ridge 28. As will be apparent, when the weight of a worker is placed upon member 22, mesh 22 will deflect to provide a resilient surface which is comfortable for walking and standing. Contact of surface 42 of rod 18 with surface 40 of ridge 28 limits the deflection of mesh 22, either when the weight of a user is placed on member 22 adjacent rod 18, or on mesh 22 between rod 18 and side member 14 of upper assembly 12. As will be apparent, member 22 may deflect between rod 18 and side member 14, the deflection in this area being limited by the rigidity of mesh 22 and of end members 16. This provides a resilient and non-skid flooring surface, which is durable, and which does not result in discomfort for a user required to stand on it for a prolonged period of time.

Figure 4:
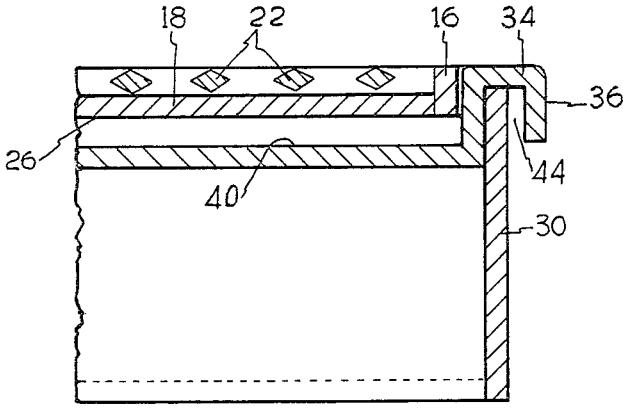
FIG. 4 is a detail view of the preferred embodiment of the invention, take in direction 4—4 as shown in FIG. 2.

As will be apparent, from inspection of FIG. 4, the gap 44 between depending member 36 of hook member 34 and end wall 30 is adapted to receive an end wall 30 or a side wall 32 of a similar lower member 10, for retaining a plurality of members 10 in a desired configuration.

As will be apparent, numerous modification and variations of the disclosed embodiment of the invention may be constructed without departing from the scope and spirit of the invention.

We claim:

1. A dust collection and walkway device, comprising:

a first generally pan-shaped member;

a cover member forming a frame and adapted to cooperate with said first member and be supported upon said first member;

said cover member including a perforated planar member attached to said frame;

said frame including a support member;

said first member including a second support member adapted to be in alignment with said support member when said first member and said cover member are aligned;

said first member including means adapted to engage a second said first member for attaching said first member to said second said first member;

said perforated planar member and said support member being resiliently deformable, whereby said perforated planar member and said support member may be deformed by the weight of a user, said deformation of said support member being limited by contact with said second support member when said second member and said first member are aligned.

2. A dust collection and walkway device according to claim 1, wherein:

said first member includes a lip portion adapted to cooperate with said cover member to removably support said cover member upon said first member.

3. A dust collection and walkway device according to claim 1, wherein:

said perforated planar member is an expanded metallic mesh material.

4. A dust collection and walkway device according to claim 1, wherein:

said support member is a rod member located along a longitudinal axis of said frame, said frame having a longitudinal axis.

5. A dust collection and walkway device according to claim 1, wherein:

said means adapted to engage a second said first member is a hook member;

said frame being smaller than said first member for providing a space therebetween adapted to receive a hook member of another said first member.

6. A dust collection and walkway device according to claim 1, wherein:

said second support member is a raised portion of said first member;

said raised portion being located upon a longitudinal axis of said first member, said first member having a longitudinal axis.

* * * * *